US010749284B2

(12) United States Patent
Maruno et al.

(10) Patent No.: US 10,749,284 B2
(45) Date of Patent: Aug. 18, 2020

(54) CONNECTOR AND TERMINAL CONNECTION STRUCTURE WITH INCREASED HOLDING FORCE WHILE SUPPRESSIONG THE INCREASE OF PARTS

(71) Applicant: Yazaki Corporation, Tokyo (JP)

(72) Inventors: Kazuhiro Maruno, Shizuoka (JP); Hiroki Komatsu, Shizuoka (JP); Fuminori Sugiyama, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 10 days.

(21) Appl. No.: 16/222,328

(22) Filed: Dec. 17, 2018

(65) Prior Publication Data

US 2019/0190180 A1 Jun. 20, 2019

(30) Foreign Application Priority Data

Dec. 18, 2017 (JP) ..... 2017-241468

(51) Int. Cl.

| | |
|---|---|
| ***H01R 13/05*** | (2006.01) |
| ***H01R 13/15*** | (2006.01) |
| ***H01R 13/11*** | (2006.01) |
| ***H01R 13/18*** | (2006.01) |
| *H01R 13/193* | (2006.01) |

(52) U.S. Cl.

CPC ..... *H01R 13/15* (2013.01); *H01R 13/111* (2013.01); *H01R 13/18* (2013.01); *H01R 13/193* (2013.01)

(58) Field of Classification Search

CPC ..... H01R 13/111; H01R 13/15; H01R 13/18; H01R 13/193; H01R 13/11

USPC ..... 439/825, 842

See application file for complete search history.

(56) References Cited

U.S. PATENT DOCUMENTS

| | | | | |
|---|---|---|---|---|
| 3,912,353 | A * | 10/1975 | Kasuya | H01R 12/89 439/329 |
| 5,391,089 | A * | 2/1995 | Quickel | H01R 13/193 439/260 |
| 10,177,489 | B1 * | 1/2019 | Aoshima | H01R 13/631 |
| 2015/0207242 | A1 * | 7/2015 | Sugiyama | H01R 13/11 439/856 |
| 2015/0207255 | A1 * | 7/2015 | Sugiyama | H01R 13/193 439/852 |

FOREIGN PATENT DOCUMENTS

| | | | |
|---|---|---|---|
| JP | 2007-095671 | A | 4/2007 |
| JP | 2014-75217 | A | 4/2014 |
| JP | 2016-46131 | A | 4/2016 |

* cited by examiner

*Primary Examiner* — Hae Moon Hyeon

(74) *Attorney, Agent, or Firm* — Sughrue Mion, PLLC

(57) ABSTRACT

A connector includes a male terminal, a housing having a housing portion that houses the male terminal, and a pressing member arranged in the housing portion. A female terminal having a proximal portion and a contact segment formed in a cantilever-like shape and extending from the proximal portion, is inserted into the housing portion. The pressing member holds the contact segment of the female terminal that is inserted into the housing portion between the pressing member and the male terminals, elastically deforms the contact segment, and presses the contact segment toward the male terminal.

6 Claims, 5 Drawing Sheets

CONNECTOR AND TERMINAL CONNECTION STRUCTURE WITH INCREASED HOLDING FORCE WHILE SUPPRESSIONG THE INCREASE OF PARTS

CROSS-REFERENCE TO RELATED APPLICATION(S)

The present application claims priority to and incorporates by reference the entire contents of Japanese Patent Application No. 2017-241468 filed in Japan on Dec. 18, 2017.

BACKGROUND OF THE INVENTION

1. Field of the Invention

The present invention relates to a connector and a terminal connection structure.

2. Description of the Related Art

Conventionally, there has been a technique that holds a male terminal by being held with a female terminal. Japanese Patent Application Laid-open No. 2007-95671 discloses a technique of an electrical connector provided with a contact including a pair of elastic pieces capable of inserting thereinto a rod-like terminal along a terminal mounting direction corresponding to the radial direction of the terminal, the contact being supported by a housing, and an operation member capable of operating the contact so as to adjust the pressing force of the elastic pieces with respect to the terminal.

Japanese Patent Application Laid-open No. 2014-75217 discloses a technique of a connector provided with a connector housing having a terminal housing chamber, and a female terminal housed in the terminal housing chamber, the female terminal having a terminal connection part into which a male terminal is inserted. In the connector according to Japanese Patent Application Laid-open No. 2014-75217, the female terminal has a pressure-force receiving portion housed in the terminal housing chamber in a movable manner in the insertion direction of the male terminal and pressed by the male terminal in the insertion process of the male terminal, the terminal connection part is located at a non-contact position spaced apart from the male terminal inserted and is displaceable to a contact position where the terminal connection part is brought into contact with the male terminal, and the connector housing is provided with a pressing portion that presses the terminal connection part toward the contact position in a process where the female terminal is moved by being pressed with the male terminal.

In the connector according to Japanese Patent Application Laid-open No. 2014-75217, at least the male terminal and the female terminal are not slid on each other at the contact portion therebetween until the male terminal presses the pressure-force receiving portion of the female terminal so that the terminal connection part of the female terminal receives the pressing force from the male terminal in the direction where the female terminal is brought into contact with the male terminal. This structure reduces the amount of sliding stroke, thereby reducing the sliding abrasion of the male terminal and the female terminal.

In the electrical connector according to Japanese Patent Application Laid-open No. 2007-95671, and the connector according to Japanese Patent Application Laid-open No. 2014-75217, in order to achieve required pressing force, it is necessary to change in overall design in response to the change in the diameter of the terminal, or the like. As a result, the number of kinds of parts increases thus causing the increase in cost.

SUMMARY OF THE INVENTION

An object of the present invention is to provide a connector and a terminal connection structure that are capable of achieving an appropriate holding force while suppressing the increase in the number of kinds of parts.

A connector according to one aspect of the present invention includes a male terminal; a housing having a housing portion that houses the male terminal; and a pressing member arranged in the housing portion, wherein a female terminal having a proximal portion and a contact segment formed in a cantilever-like shape and extending from the proximal portion, is inserted into the housing portion, and the pressing member holds the contact segment of the female terminal inserted into the housing portion between the pressing member and the male terminal, elastically deforms the contact segment, and presses the contact segment toward the male terminal.

A terminal connection structure according to another aspect of the present invention includes a female terminal having a proximal portion and a contact segment that is formed in a cantilever-like shape and extending from the proximal portion; and a connector provided with a male terminal, a housing having a housing portion that houses the male terminal, and a pressing member arranged in the housing portion, the female terminal being inserted into the housing portion, wherein the pressing member holds the contact segment of the female terminal inserted into the housing portion between the pressing member and the male terminal, elastically deforms the contact segment, and presses the contact segment toward the male terminal.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a connector and a terminal connection structure according to an embodiment of the present invention in detail with reference to drawings. Here, the present invention is not limited to this embodiment. Furthermore, constitutional features in the following embodiment include a part that is easily conceivable by those skilled in the art, or parts substantially equal to each other.

Embodiment

Figure 1:
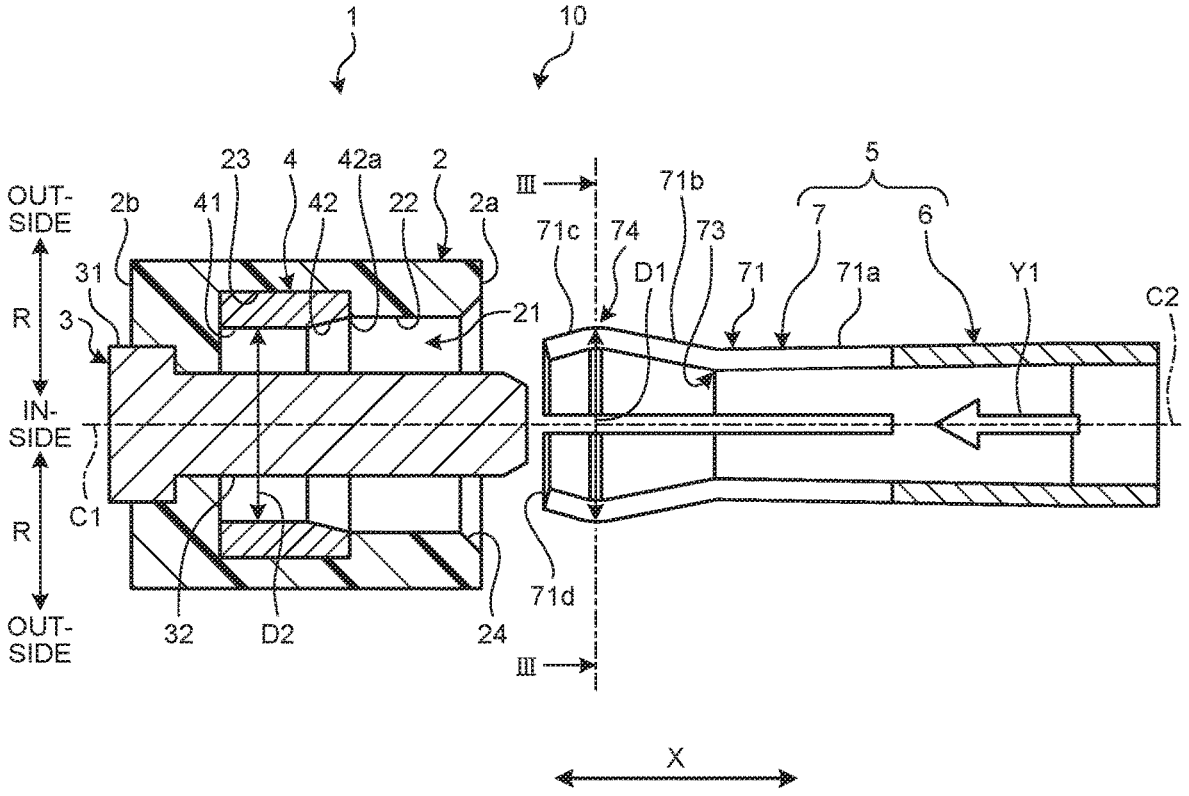
FIG. 1 is a sectional view of a connector and a terminal connection structure according to an embodiment.
Figure 2:
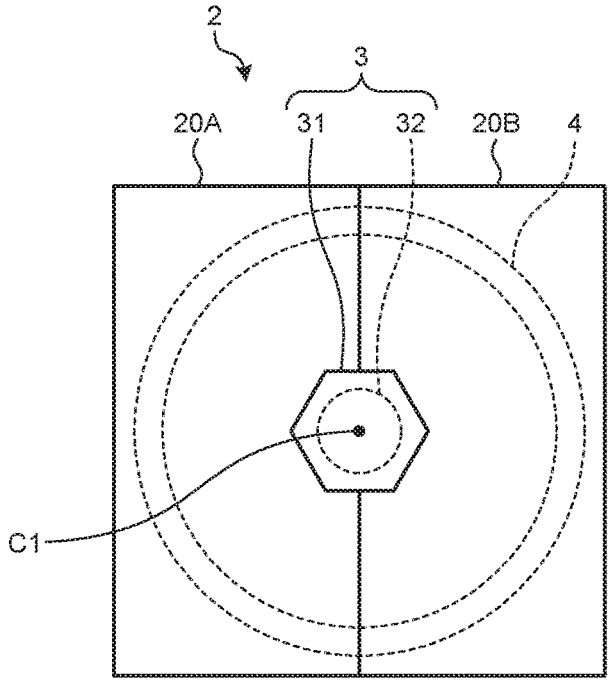
FIG. 2 is a side view of the connector according to the embodiment.
Figure 3:
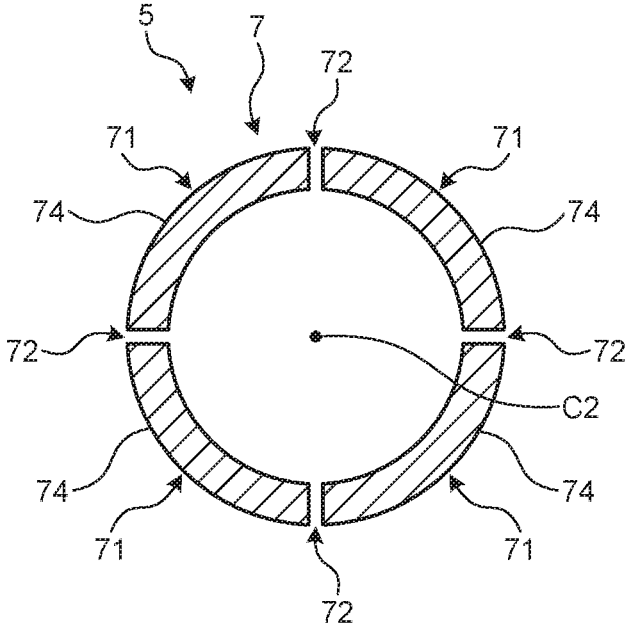
FIG. 3 is a cross-sectional view of a terminal connection part according to the embodiment.
Figure 4:
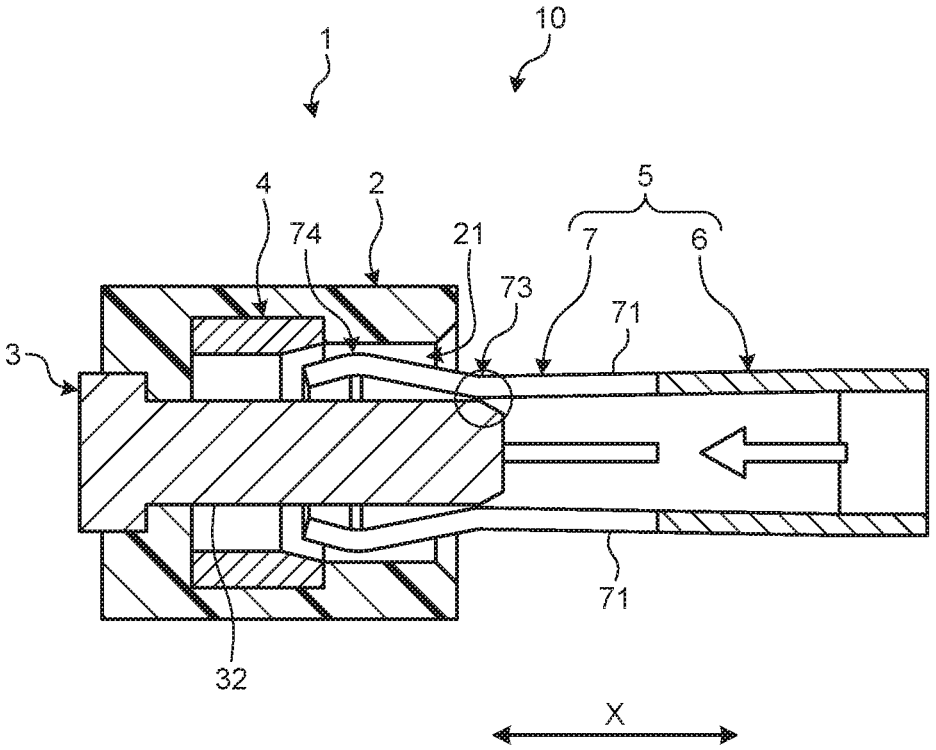
FIG. 4 is a sectional view illustrating an insertion process of a female terminal in the embodiment.
Figure 5:
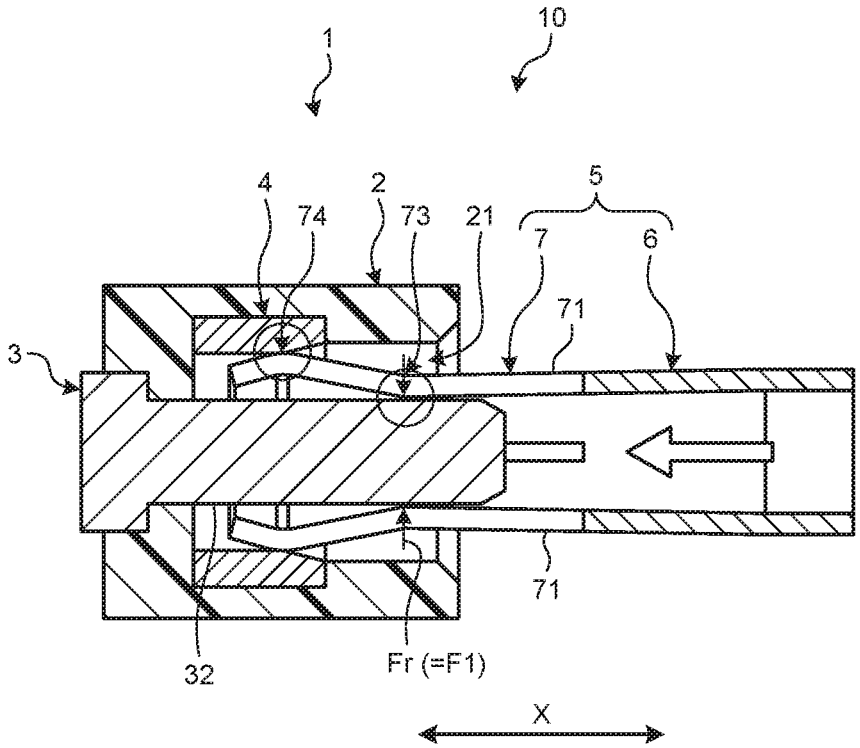
FIG. 5 is another sectional views illustrating the insertion process of the female terminal in the embodiment.
Figure 6:
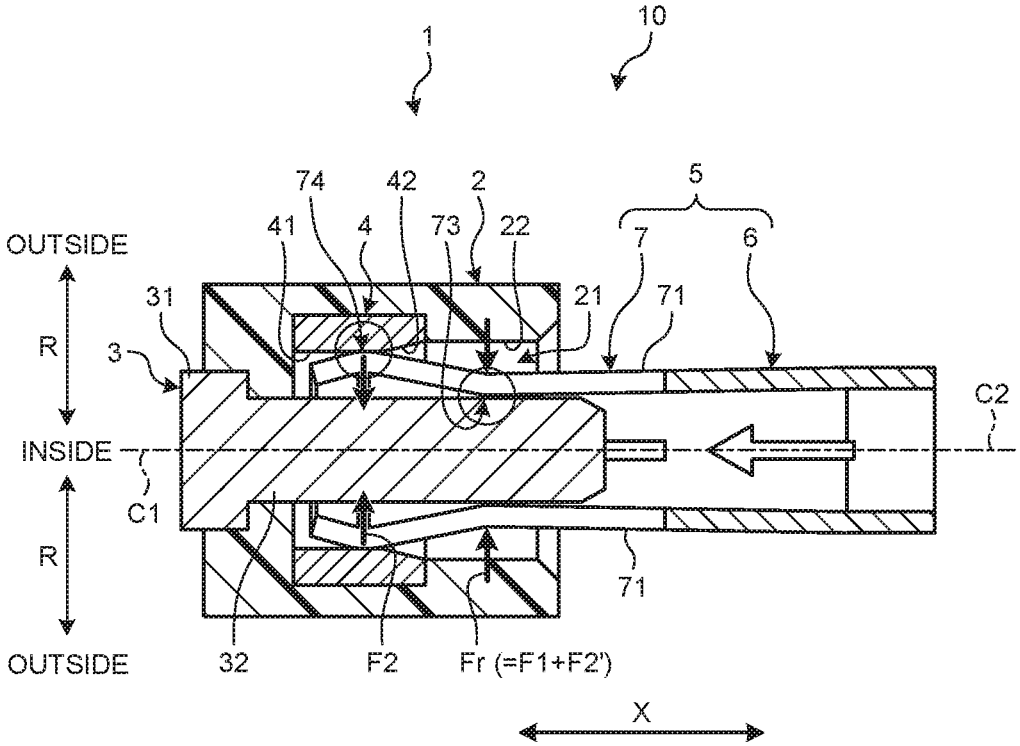
FIG. 6 is still another sectional view illustrating the insertion process of the female terminal in the embodiment.

The embodiment is explained with reference to FIG. 1 to FIG. 6. The present embodiment relates to a connector and a terminal connection structure. FIG. 1 is a sectional view of the connector and the terminal connection structure according to the embodiment, FIG. 2 is a side view of the connector according to the embodiment, FIG. 3 is a cross-sectional view of a terminal connection part according to the embodiment, FIG. 4 is a sectional view illustrating an insertion process of a female terminal in the embodiment, FIG. 5 is another sectional views illustrating the insertion process of the female terminal in the embodiment, and FIG. 6 is still another sectional view illustrating the insertion process of the female terminal in the embodiment. FIG. 3 illustrates the cross-sectional view taken along a line III-III in FIG. 1.

As illustrated in FIG. 1, a connector 1 according to the embodiment has a housing 2, a male terminal 3, and a pressing member 4. Furthermore, a terminal connection structure 10 according to the embodiment has the connector 1 and a female terminal 5.

The connector 1 of the present embodiment is a male connector having the male terminal 3. The male terminal 3 has a part to be held 31 and a columnar part 32. The part to be held 31 and the columnar part 32 are formed of a material having conductivity as an integral body. The male terminal 3 is, for example, formed of a metal such as copper or aluminum. The columnar part 32 is a constitutional part formed in a pillar shape or a rod-like shape. The part to be held 31 is connected with one end of the columnar part 32. The cross-sectional shape of the columnar part 32 is, for example, circular. In the following explanation, the axial direction of the columnar part 32 is merely referred to as "an axial direction X." Furthermore, the direction orthogonal to the axial direction X is referred to as "a radial direction R" with respect to a central axis line C1 of the columnar part 32 that is set as the center. The part to be held 31 outwardly extends from the columnar part 32 along the radial direction R. The cross-sectional shape of the part to be held 31 is, for example, polygonal or circular.

The housing 2 is a member that has a housing portion 21 for housing the male terminal 3, and holds the male terminal 3. The housing 2 is, for example, formed of an insulative synthetic resin. The external shape of the housing 2 is, for example, parallelepiped or columnar. The housing portion 21 is a recessed portion that opens toward one side in the axial direction X. That is, the housing portion 21 extends from one end surface 2*a* towards the other end surface 2*b* of the housing 2 along the axial direction X. The housing portion 21 is, for example, formed in such a manner that the housing portion 21 is arranged coaxially with the central axis line C1 of the male terminal 3. That is, the male terminal 3 is housed in the housing portion 21 so that the central axis line C1 of the columnar part 32 can be aligned with the central axis line of the housing portion 21. The columnar part 32 is arranged so that the distal end of the columnar part 32 can project from the housing portion 21 to the outside of the housing portion 21. The cross-sectional shape of the housing portion 21 of the present embodiment is circular.

The housing portion 21 has a wall portion 22 that faces the male terminal 3 in a spaced-apart manner from the peripheral face of the male terminal 3. A contact segment 71 of the female terminal 5 is inserted into a space between the wall portion 22 and the male terminal 3. The housing portion 21 has a holding portion 23. The holding portion 23 is arranged on the inner side of the housing portion 21. The holding portion 23 extends from the entrance-side portion of the housing portion 21 towards the outside in the radial direction R. That is, the inside diameter of the holding portion 23 is larger than the inside diameter of the entrance-side portion in the housing portion 21. The housing portion 21 has a tapered portion 24 formed in the entrance portion thereof. The tapered portion 24 is an inclined face inclined with respect to the axial direction X. The inside diameter of the tapered portion 24 is reduced along with the extension of the tapered portion 24 toward the inner side of the housing portion 21 along the axial direction X.

The housing 2 of the present embodiment is, as illustrated in FIG. 2, a split-type housing having a first constitutional part 20A and a second constitutional part 20B. The first constitutional part 20A and the second constitutional part 20B are arranged in line symmetry with respect to a virtual plane including the central axis line C1. The part to be held 31 of the male terminal 3 is sandwiched between the first constitutional part 20A and the second constitutional part 20B thus being held by the housing 2.

As illustrated in FIG. 1, the pressing member 4 is housed in the holding portion 23 of the housing 2, and held by the holding portion 23. The pressing member 4 of the present embodiment has an annular shape. The pressing member 4 is arranged coaxially with the central axis line C1. An inner peripheral face 41 of the pressing member 4 has a tapered portion 42. The tapered portion 42 is formed in an end portion located on the entrance side of the pressing member 4 in the axial direction X. The tapered portion 42 is an inclined face inclined with respect to the axial direction X. The inside diameter of the tapered portion 42 is reduced along with the extension of the tapered portion 42 toward the inner side of the housing portion 21 along the axial direction X. An end portion 42*a* located on the entrance side of the tapered portion 42 continuously extends to the wall portion 22 of the housing portion 21. The inside diameter of the inner peripheral face 41 is made constant on a portion inner than the tapered portion 42.

The female terminal 5 constitutes a mating connector connected with the connector 1. The mating connector has a housing that holds the female terminal 5 in addition to the female terminal 5. The female terminal 5 has a proximal portion 6 and a terminal connection portion 7. The proximal portion 6 and the terminal connection portion 7 are formed of a material having conductivity into an integral body. The female terminal 5 is, for example, formed of a metal, such as copper or aluminum. In the female terminal 5 of the present embodiment, the proximal portion 6 is formed in a tubular shape. The proximal portion 6 has, for example, a cylindrical shape. The outside diameter of the proximal portion 6 is smaller than the inside diameter of the housing portion 21. Furthermore, the inside diameter of the proximal portion 6 is larger than the outside diameter of the columnar part 32 of the male terminal 3.

The terminal connection portion 7 has at least one contact segment 71. The contact segment 71 is a constitutional part formed in a cantilever-like shape that extends from one end of the proximal portion 6. The contact segment 71 projects from the proximal portion 6 along the axial direction of the proximal portion 6. The female terminal 5 of the present embodiment is what is called a slit terminal, and the terminal connection portion 7 has the contact segments 71. As illustrated in FIG. 3, the contact segments 71 are arranged along a circumferential direction about the central axis line C2 of the female terminal 5. A slit 72 is formed between two contact segments 71 adjacent to each other. The cross-sectional shape of each of the contact segments 71 is arcuate. The terminal connection portion 7 of the present embodiment has four contact segments 71. The terminal connection portion 7 is constituted so that four contact segments 71 can constitute a demarcated annular shape as viewed in a cross-sectional view.

The contact segment 71 is elastically deformable. As illustrated in FIG. 1, the contact segment 71 has a contact portion 73 and a portion to be pressed 74. In the contact segment 71 of the present embodiment, the contact portion 73 is located closer to the proximal portion 6 side than the portion to be pressed 74. The contact portion 73 is a portion that is physically and electrically brought into contact with the outer peripheral face of the male terminal 3. The contact portion 73 is bent in a convex shape towards the central axis line C2 side of the female terminal 5. The contact portion 73 of the present embodiment is bent so that the contact portion 73 can be substantially brought into line contact with the male terminal 3. In the following explanation, in the contact segment 71, the portion located closer to the proximal portion 6 than the contact portion 73 is referred to as a proximal end portion 71*a*, the portion located between the contact portion 73 and the portion to be pressed 74 is referred to as an intermediate portion 71*b*, and the portion located closer to the distal end than the portion to be pressed 74 is referred to as a distal end portion 71*c*.

The proximal end portion 71*a* is slightly inclined with respect to the central axis line C2 in the direction toward the central axis line C2 along with the extension of the proximal end portion 71*a* toward the distal end side of the contact segment 71. On the other hand, the intermediate portion 71*b* is inclined with respect to the central axis line C2 in the direction away from the central axis line C2 along with the extension of the intermediate portion 71*b* toward the distal end side of the contact segment 71. Consequently, the contact portion 73 further projects toward the central axis line C2 than portions adjacent to the contact portion 73 in the contact segment 71.

The portion to be pressed 74 is a portion to be pressed by the pressing member 4. The portion to be pressed 74 is further spaced apart from the central axis line C2 than the contact portion 73 is in the direction orthogonal to the central axis line C2. That is, the portion to be pressed 74 is located more outside in the radial direction R than the contact portion 73 is. The portion to be pressed 74 of the present embodiment is bent in a convex shape towards a side opposite to the central axis line C2. The distal end portion 71*c* of the contact segment 71 is inclined with respect to the central axis line C2 such that the distal end portion 71*c* becomes closer to the central axis line C2 as the distal end portion 71*c* extends toward the distal end side of the contact segment 71. The portion to be pressed 74 further projects towards a side opposite to the central axis line C2 than a portion adjacent to the portion to be pressed 74 in the contact segment 71. Here, a distal end 71*d* of the distal end portion 71*c* is further spaced apart from the central axis line C2 than the contact portion 73 is. That is, the distal end 71*d* is located more outside of the contact portion 73 in the radial direction.

As indicated by an arrow Y1 in FIG. 1, the female terminal 5 is inserted into the housing portion 21 of the housing 2 with the distal end 71*d* side thereof in the lead. The columnar part 32 of the male terminal 3 is inserted into the terminal connection portion 7 of the female terminal 5. That is, each of the contact segments 71 of the female terminal 5 is inserted into the space between the columnar part 32 and the wall portion 22. When the terminal connection portion 7 is inserted into the housing portion 21, as illustrated in FIG. 4, the contact portion 73 of the contact segment 71 is brought into contact with the columnar part 32.

The terminal connection portion 7 of the present embodiment holds the columnar part 32 inserted thereinto by the elastic force of each of the contact segments 71. To be more specific, the inside diameter of the terminal connection portion 7 at the contact portion 73 is smaller than the outside diameter of the columnar part 32. Accordingly, the columnar part 32 inserted into the terminal connection portion 7 presses each of the contact segments 71 toward the outside in the radial direction R, and elastically deforms the contact segments 71. The columnar part 32 is inserted into the inner portion of the terminal connection portion 7 while expanding the terminal connection portion 7 to the outside in the radial direction. The contact segments 71 sandwich the columnar part 32 with their restoring forces F1 illustrated in FIG. 5 to hold the columnar part 32. That is, a pressing force Fr applied to the columnar part 32 by the contact segment 71 is equal to the restoring force F1.

When the female terminal 5 is further inserted into the inner portion of the housing portion 21, the portion to be pressed 74 of the terminal connection portion 7 is brought into contact with the pressing member 4. As a result, the pressing member 4 and the columnar parts 32 of the male terminal 3 sandwich the contact segments 71 of the female terminal 5 therebetween. The terminal connection portion 7 of the present embodiment has an outside diameter D1 (see FIG. 1) at the portion to be pressed 74, the outside diameter D1 being larger than an inside diameter D2 of the pressing member 4. The size of the outside diameter D1 may assume a value in a state that the columnar part 32 is not inserted into the terminal connection portion 7 (in a state illustrated in FIG. 1), and may assume a value in a state that the columnar part 32 is inserted into the terminal connection portion 7 to expand the terminal connection portion 7 (in a state illustrated in FIG. 5).

The outside diameter D1 of the portion to be pressed 74 is larger than the inside diameter D2 of the pressing member 4 and hence, the terminal connection portion 7 is press-fitted in the pressing member 4. That is, as illustrated in FIG. 6, the terminal connection portion 7 inserted into the pressing member 4 receives a force F2 applied thereto inwardly in the radial direction R from the pressing member 4. Due to the force F2, the pressing force Fr that presses the contact portion 73 to the columnar part 32 increases. That is, the pressing force Fr is a resultant force of the restoring force F1 of the contact segment 71 and a force F2' corresponding to the force F2 received from the pressing member 4.

Consequently, the connector 1 of the present embodiment is capable of generating the pressing force Fr that is sufficiently large. In an early stage of the process of inserting the female terminal 5 into the housing portion 21, the pressing force Fr (=F1) is small. Accordingly, a force required for inserting the female terminal 5 into the housing portion 21 is also small. On the other hand, when the portion to be pressed 74 is inserted into the pressing member 4, the pressing force Fr (=F1+F2') becomes large. The pressing force Fr increases in the final stage of an insertion process that is the process of inserting the female terminal 5 into the housing portion 21. Consequently, the workload with respect to the insertion process is minimized.

As a comparative example with respect to the present embodiment, a constitution is considered that generates the pressing force Fr that is large with the restoring force F1 of the contact segment 71 without arranging the pressing member 4. In the comparative example, even in the early stages of the insertion process, a large force is required for inserting the female terminal 5 into the housing portion 21. Consequently, the workload with respect to the insertion process becomes excessively large. On the other hand, in the connector 1, and the terminal connection structure 10 according to the present embodiment, it is possible to achieve the pressing force Fr that is large while reducing the workload of the insertion process.

As explained heretofore, the connector 1 of the present embodiment has the male terminal 3, the housing 2, and the pressing member 4. The housing 2 has the housing portion 21 that houses the male terminal 3. The female terminal 5 having the proximal portion 6, and the contact segment 71 that is formed in a cantilever-like shape, and extends from the proximal portion 6 is inserted into the housing portion 21. The pressing member 4 holds the contact segment 71 of the female terminal 5 that is inserted into the housing portion 21 between the pressing member 4 and the male terminals 3, elastically deforms the contact segment 71, and presses the contact segment 71 toward the male terminal 3. In the connector 1 of the present embodiment, the pressing member 4 presses the contact segment 71 of the female terminal 5 toward the male terminal 3. Consequently, it is possible to improve the holding force of the female terminal 5 that holds the male terminal 3.

In the connector 1 of the present embodiment, the pressing member 4 is a member separated from the housing 2. Accordingly, the change of the pressing member 4 allows the connector 1 to correspond to various requirements for the connector 1. For example, it is conceivable that a required load to be applied to the contact portion of the male terminal 3 with the female terminal 5 varies depending on the type of vehicle, or the like. In this case, the connector 1 of the present embodiment uses the pressing member 4 having an appropriate inside diameter thus ensuring the required load. Furthermore, the pressing member 4 having an inside diameter appropriate for each of various types of the female terminals 5 is used thus ensuring the required load. Accordingly, in the connector 1 of the present embodiment, one kind of the housing 2 is combined with each of the pressing members 4 having respective inside diameters different from each other thus achieving various contact loads. As a result, the connector 1 of the present embodiment is capable of achieving an appropriate holding force while suppressing the increase in the number of kinds of parts.

The contact segment 71 of the present embodiment has the contact portion 73 and the portion to be pressed 74. The contact portion 73 is bent in a convex shape toward the central axis line C2 of the female terminal 5, and brought into contact with the male terminal 3. The portion to be pressed 74 is further spaced apart from the central axis line C2 than the contact portion 73 is in the direction orthogonal to the central axis line C2. The pressing member 4 is brought into contact with the portion to be pressed 74 to press the portion to be pressed 74 toward the male terminal 3. The contact portion 73 is bent in a convex shape thus stabilizing a position and conditions of contact between the contact portion 73 and the male terminal 3. Furthermore, the contact portion 73 is bent in a convex shape thus reducing frictional resistance when the female terminal 5 is inserted into the housing portion 21. Furthermore, the portion to be pressed 74 is further spaced apart from the central axis line C2 than the contact portion 73 is. Consequently, a space for elastically deforming the contact segment 71 is ensured.

The female terminal 5 of the present embodiment has the contact segments 71 arranged so as to surround the central axis line C2 of the female terminal 5. The pressing member 4 presses each of the contact segments 71 toward the male terminal 3. Each of the contact segments 71 is pressed toward the male terminal 3 and hence, the decentering of the female terminal 5 hardly occurs. Furthermore, a contact load between each of the contact segments 71 and the male terminal 3 is easily stabilized. It is preferable to arrange the contact segments 71 at equal intervals along the circumferential direction.

The terminal connection structure 10 of the present embodiment has the female terminal 5 and the connector 1. The female terminal 5 has the proximal portion 6, and the contact segments 71 that extend from the proximal portion 6, each of the contact segments 71 being formed in a cantilever-like shape. The connector 1 has the male terminal 3, the housing 2 having the housing portion 21 that houses the male terminal 3, and the pressing member 4 arranged in the housing portion 21. The pressing member 4 holds the contact segment 71 of the female terminal 5 that is inserted into the housing portion 21 between the pressing member 4 and the male terminals 3, elastically deforms the contact segment 71, and presses the contact segment 71 toward the male terminal 3. Consequently, the terminal connection structure 10 according to the present embodiment is capable of improving the holding force of the female terminal 5 that holds the male terminal 3. Furthermore, the terminal connection structure 10 according to the present embodiment is capable of achieving the appropriate holding force while suppressing the increase in the number of kinds of parts.

First Modification of Embodiment

Figure 7:
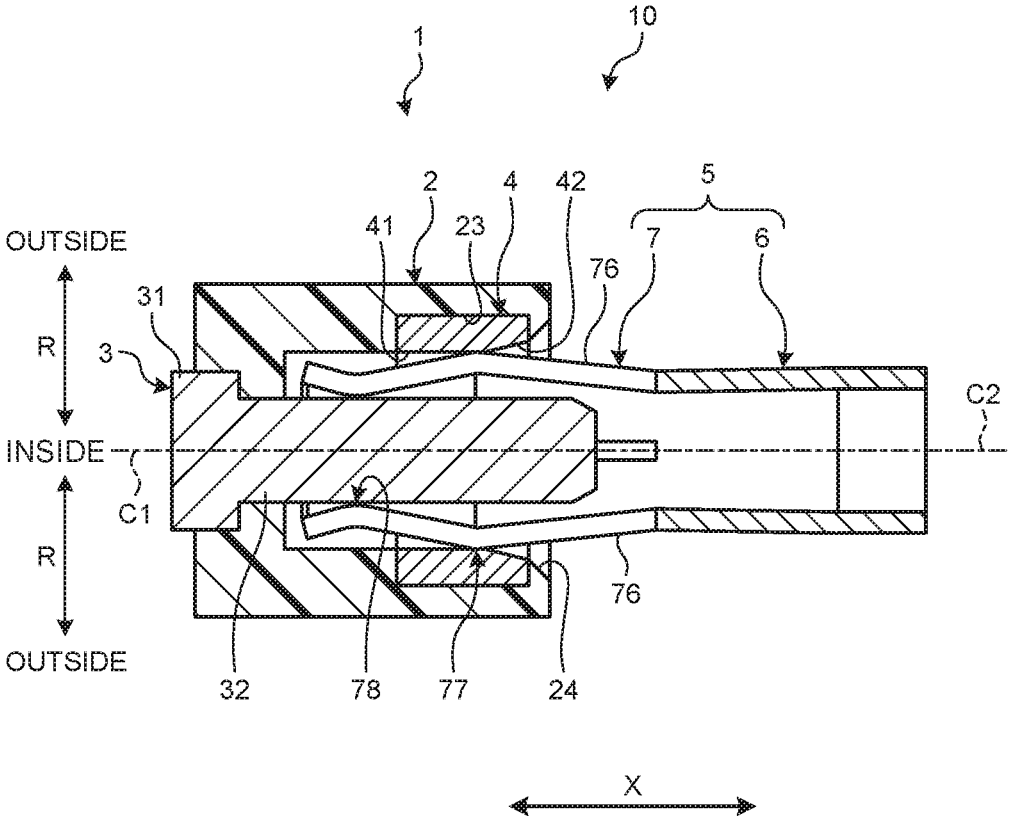
FIG. 7 is a sectional view of a connector and a terminal connection structure according to a first modification of the embodiment.

The first modification of the embodiment is explained. FIG. 7 is a sectional view of a connector and a terminal connection structure according to the first modification of the embodiment. The connector 1 and the terminal connection structure 10 of the first modification differ in the shape of the female terminal 5 that is a mating terminal, and the arrangement of the pressing member 4, from the case of the above-mentioned embodiment.

As illustrated in FIG. 7, the female terminal 5 according to the first modification has a contact segment 76 in place of the contact segment 71 of the above-mentioned embodiment. In the contact segment 76 of the first modification, a contact portion 78 is located closer to the distal-end side of the contact segment 76 than a portion to be pressed 77 is. The contact portion 78 is bent in a convex shape towards the central axis line C2 of the female terminal 5. The portion to be pressed 77 is further spaced apart from the central axis line C2 than the contact portion 78 is in the direction orthogonal to the central axis line C2. Furthermore, the portion to be pressed 77 is bent in a convex shape towards a side opposite to the central axis line C2 side of the female terminal 5.

The pressing member 4 is arranged on the entrance side of the housing portion 21. When the female terminal 5 is inserted into the housing portion 21, the contact portion 78 is first brought into contact with the columnar part 32 of the male terminal 3. The columnar part 32 is inserted into the terminal connection portion 7, and held by the contact segments 76. When the female terminal 5 is further inserted into the inner side of the housing portion 21, as illustrated in FIG. 7, the portion to be pressed 77 is brought into contact with the pressing member 4. The pressing member 4 holds the contact segments 76 between the pressing member 4 and the male terminal 3, elastically deforms the contact segments 76, and presses the contact segments 76 toward the male terminal 3. The pressing member 4 may be arranged so that the tapered portion 24 of the housing 2 and the tapered portion 42 of the pressing member 4 can be continuously connected with each other.

Second Modification of Embodiment

Figure 8:
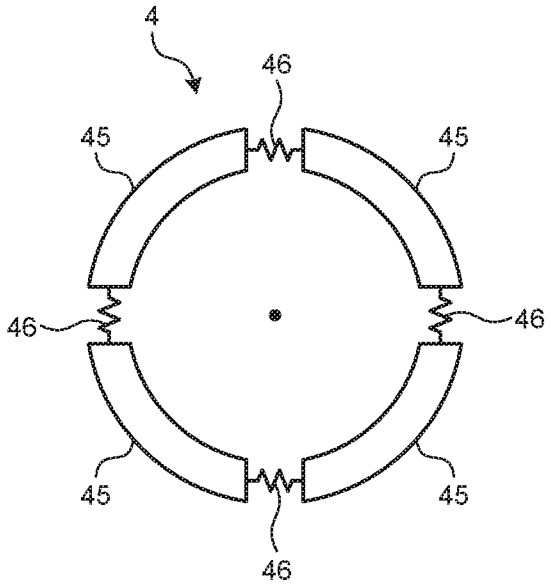
FIG. 8 is a front view of a pressing member according to a second modification of the embodiment.

The second modification of the embodiment is explained. FIG. 8 is a front view of a pressing member according to the second modification of the embodiment. The pressing member 4 according to the second modification of the embodiment differs from the pressing member 4 of the embodiment in that the pressing member 4 according to the second modification is formed in a stretchable manner in the radial direction thereof.

As illustrated in FIG. 8, the pressing member 4 according to the second modification has a plurality of pressing segments 45, and a plurality of elastic members 46. The pressing segments 45 are connected with each other by way of the respective elastic members 46. Each of the pressing segments 45 is formed in an arcuate shape. The elastic member 46 connects the respective end portions of two pressing segments 45. The pressing member 4 illustrated in FIG. 8 has four pressing segments 45 and four elastic members 46. Four pressing segments 45 are connected with each other so as to form an annular shape.

The elastic member 46 is an elastically deformable member, such as a spring or a rubber. The elastic member 46 is elastically deformed thus changing the outside diameter of the pressing member 4. The pressing member 4 is, for example, inserted into the holding portion 23 of the housing 2 in a state that the elastic member 46 is shrunk. In this case, it is unnecessary to form the housing 2 in a split manner. The pressing member 4 is, for example, inserted into the housing portion 21 from the end surface 2*a* side of the housing 2. When the pressing member 4 is pressed into the holding portion 23, the diameter of the pressing member 4 increases due to the restoring force of the elastic member 46, and the pressing member 4 is held by the holding portion 23. The number of each of the pressing segments 45 and the elastic members 46 is not limited to four.

Here, in the pressing member 4, a part corresponding to the pressing segment 45 and a part corresponding to the elastic member 46 may be formed of respective materials identical with each other. For example, the structures of the pressing member 4 may be a connection structure including parts each of which has a relatively large sheet thickness (parts each corresponding to the pressing segment 45), and parts each of which has a relatively small sheet thickness (parts each corresponding to the elastic member 46) that are alternately arranged next to each other, each of these parts being a metal-made member formed in an annular shape. The part having a small sheet thickness functions as a thin-wall hinge part. When a compressive force in the radial direction is applied to the pressing member 4, the thin-wall hinge part is elastically deformed, and the diameter of the pressing member 4 is reduced. When the compressive force is released, the diameter of the pressing member 4 increases due to the elastic restoring force of the thin-wall hinge part.

Third Modification of Embodiment

Figure 9:
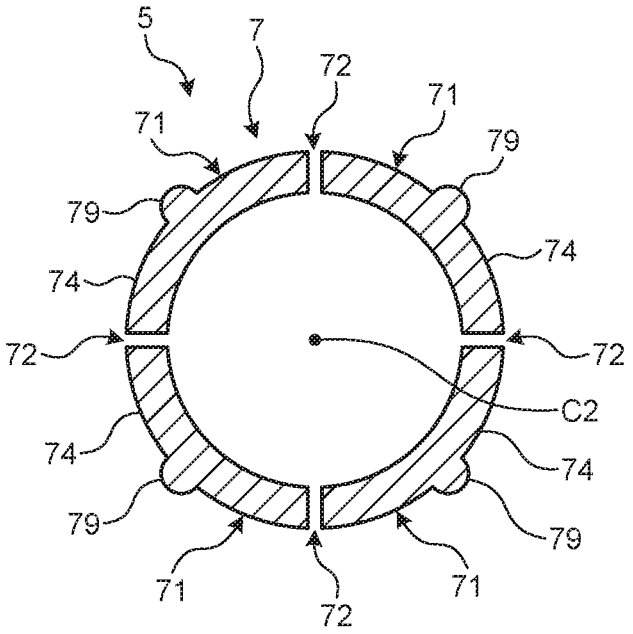
FIG. 9 is a cross-sectional view of a female terminal according to a third modification of the embodiment.

The third modification of the embodiment is explained. FIG. 9 is a cross-sectional view of a female terminal according to the third modification of the embodiment. FIG. 9 illustrates a cross-sectional view of the portion to be pressed 74. The female terminal 5 according to the third modification of the embodiment differs from the female terminal 5 of the above-mentioned embodiment in that the portion to be pressed 74 has an indent 79.

As illustrated in FIG. 9, each of the contact segments 71 has the indent 79. The indent 79 is formed on the outside surface in the radial direction of the portion to be pressed 74. The indent 79 forms a projecting portion that projects toward the outside in the radial direction of the portion to be pressed 74. The indent 79 has, for example, a semi-spherical shape. The indent 79 is, for example, arranged in the center portion of the portion to be pressed 74 in a circumferential direction. The indent 79 is brought into contact with the pressing member 4, and receives a pressing force applied thereto from the pressing member 4 toward the inside in the radial direction of the pressing member 4. The indent 79 is arranged thus stabilizing the contact position between the contact segment 71 and the pressing member 4. Furthermore, the fluctuation in pressing force with respect to each of the contact segments 71 hardly occurs.

Fourth Modification of Embodiment

The fourth modification of the embodiment is explained. The shape or the constitution of the male terminal 3, the female terminal 5, the pressing member 4, or the like is not limited to the shape or the constitution that are exemplified in the above-mentioned embodiment or each modification. For example, the female terminal 5 may have one of the contact segments 71 and 76 that are elastically deformable, and contact segments each of which is substantially not elastically deformable.

The contents disclosed in the above-mentioned embodiment and modifications can be brought into practice by optionally combining the embodiment and the modifications with each other.

The connector according to the present embodiment and the modifications includes the male terminal, the housing having the housing portion that houses the male terminal, and the pressing member arranged in the housing portion. The female terminal having the proximal portion, and the contact segments each of which is formed in a cantilever-like shape and extends from the proximal portion, is inserted into the housing portion. The pressing member holds each of the contact segment of the female terminal that is inserted into the housing portion between the pressing member and the male terminals, elastically deforms the contact segments, and presses the contact segments toward the male terminal. In the connector according to the present embodiment and the modifications, it is possible to achieve the advantageous effect such that the appropriate pressing member corresponding to the shape of the female terminal and the required contact load is used thus suppressing the increase in the number of kinds of parts.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a male terminal;

a housing having a housing portion that houses the male terminal; and a pressing member arranged in the housing portion, wherein a female terminal having a single proximal portion in a cylindrical shape and contact segments extending from the single proximal portion, is inserted into the housing portion, each of the contact segments is formed in a cantilever-like shape, the contact segments are arranged along a circumferential direction about a central axis line of the female terminal, and the pressing member holds the contact segment of the female terminal inserted into the housing portion between the pressing member and the male terminal, elastically deforms the contact segment, and presses the contact segment toward the male terminal.

2. The connector according to claim 1, wherein the contact segment has a contact portion that is bent in a convex shape toward the central axis line and brought into contact with the male terminal, and a portion to be pressed that is further spaced apart from the central axis line than the contact portion is in a direction orthogonal to the central axis line, and the pressing member is brought into contact with the portion to be pressed to press the portion to be pressed toward the male terminal.

3. The connector according to claim 2, wherein the pressing member presses each of the contact segments toward the male terminal.

4. The connector according to claim 1, wherein the pressing member presses each of the contact segments toward the male terminal.

5. The connector according to claim 1, wherein the male terminal includes a columnar part, the columnar part is configured to be inserted into the female terminal and deforms each of the contact segments toward outside in a radial direction, and each of the contact segments is pressed toward the columnar part by a restoring force of the contact segment and a force received from the pressing member.

6. A terminal connection structure comprising:

a female terminal having a single proximal portion in a cylindrical shape and contact segments extending from the single proximal portion; and a connector provided with a male terminal, a housing having a housing portion that houses the male terminal, and a pressing member arranged in the housing portion, the female terminal being inserted into the housing portion, wherein each of the contact segments is formed in a cantilever-like shape, the contact segments are arranged along a circumferential direction about a central axis line of the female terminal, and the pressing member holds the contact segment of the female terminal inserted into the housing portion between the pressing member and the male terminal, elastically deforms the contact segment, and presses the contact segment toward the male terminal.

* * * * *